US009623535B2

(12) United States Patent
Woehrle

(10) Patent No.: US 9,623,535 B2
(45) Date of Patent: Apr. 18, 2017

(54) FINISHING DEVICE

(71) Applicant: Supfina Grieshaber GmbH & Co. KG, Wolfach (DE)

(72) Inventor: Michael Woehrle, Gutach (DE)

(73) Assignee: SUPFINA GREISHABER GMBH & CO. KG, Wolfach (DE)

( * ) Notice: Subject to any disclaimer, the term of this patent is extended or adjusted under 35 U.S.C. 154(b) by 0 days.

(21) Appl. No.: 14/936,691

(22) Filed: Nov. 10, 2015

(65) Prior Publication Data

US 2016/0129545 A1 May 12, 2016

(30) Foreign Application Priority Data

Nov. 10, 2014 (DE) ..... 10 2014 222 848

(51) Int. Cl.
*B24B 29/00* (2006.01)

(52) U.S. Cl.
CPC ..... *B24B 29/00* (2013.01)

(58) Field of Classification Search
CPC ..... B24B 29/00; B24B 35/00; B24B 13/00; B24B 1/00; B24B 5/00; B24B 41/00; B24B 49/00; B24B 5/22; B24B 5/307; B24B 5/42; B24B 13/023; B24B 27/00; B24B 41/02; B24B 41/04
See application file for complete search history.

(56) References Cited

U.S. PATENT DOCUMENTS 3,678,915 A * 7/1972 Kikuchi ..... B24B 53/14 125/11.03
4,617,764 A * 10/1986 Reibakh ..... B24B 17/10 451/11
5,245,793 A * 9/1993 Schmitz ..... B24B 35/00 451/14
6,796,877 B1 * 9/2004 Bingham ..... B24B 1/00 451/147
7,125,312 B2 * 10/2006 Castanares ..... B24B 5/36 451/10
7,455,569 B2 * 11/2008 Schafer ..... B24B 13/0037 451/11
7,833,086 B2 * 11/2010 Mielke ..... B24B 5/36 451/11
9,446,494 B2 * 9/2016 Becker ..... B24B 11/00
2004/0168681 A1 * 9/2004 Kalb ..... B23D 45/024 125/10
2005/0255793 A1 * 11/2005 Junker ..... B24B 5/14 451/11

FOREIGN PATENT DOCUMENTS

DE 102011078735 A1 1/2013

* cited by examiner

*Primary Examiner* — Dung Van Nguyen
(74) *Attorney, Agent, or Firm* — Leydig, Voit & Mayer, Ltd.

(57) ABSTRACT

A finishing device includes a finishing tool having a grinding face and a finishing-tool holder configured to hold the finishing tool. The finishing-tool holder is movably guided on a pivot support which is pivotable about a pivot axis. A force-generating apparatus is configured to generate a pressing force, by means of which the grinding face of the finishing tool is pressed against a workpiece to be machined. The force-generating apparatus is arranged on a mounting apparatus for pivotally mounting the pivot support. A force-transmitting apparatus is configured to transmit the pressing force from the force-generating apparatus to the finishing-tool holder.

11 Claims, 8 Drawing Sheets

FINISHING DEVICE

CROSS-REFERENCE TO PRIOR APPLICATION

Priority is claimed to German Patent Application No. DE 10 2014 222 848.4, filed on Nov. 10, 2014, the entire disclosure of which is hereby incorporated by reference herein.

FIELD

The invention relates to a finishing device comprising a finishing tool, in particular a finishing stone, a finishing-tool holder for holding the finishing tool, a pivot support which is pivotable about a pivot axis and on which the finishing-tool holder is movably guided, and a force-generating apparatus for generating a pressing force, by means of which a grinding face of the finishing tool is pressed against a workpiece to be machined.

BACKGROUND

The finishing machining of a workpiece is a process for machining the surface of a workpiece, and is also referred to as "superfinishing" or a "microfinishing process". In this process, an abrasive finishing tool is pressed against the workpiece surface to be machined. During the process, the workpiece surface to be machined rotates. Usually, the rotation of the workpiece surface to be machined is overlaid with an oscillating movement, in which the finishing tool and the workpiece surface to be machined are moved relative to each other in directions that are in parallel with or inclined relative to the rotational axis.

Finishing machining of workpieces is also used for machining workpiece surfaces that are curved in profile. Examples of such workpieces are roller bearing rings, roller bearing bodies or threaded spindles comprising ball races to be machined. Such curved workpiece surfaces are usually machined using finishing stones which are pivoted back and forth about a pivot axis.

DE 10 2011 078 735 A1 discloses a finishing device which comprises a particularly torsion-resistant gear apparatus for producing a pivoting movement of the pivot support. This gear apparatus contributes to it being possible to carry out finishing machining of a workpiece with a high level of precision.

SUMMARY

In an embodiment, the present invention provides a finishing device comprising a finishing tool having a grinding face and a finishing-tool holder configured to hold the finishing tool. The finishing-tool holder is movably guided on a pivot support which is pivotable about a pivot axis. A force-generating apparatus is configured to generate a pressing force, by means of which the grinding face of the finishing tool is pressed against a workpiece to be machined. The force-generating apparatus is arranged on a mounting apparatus for pivotally mounting the pivot support. A force-transmitting apparatus is configured to transmit the pressing force from the force-generating apparatus to the finishing-tool holder.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
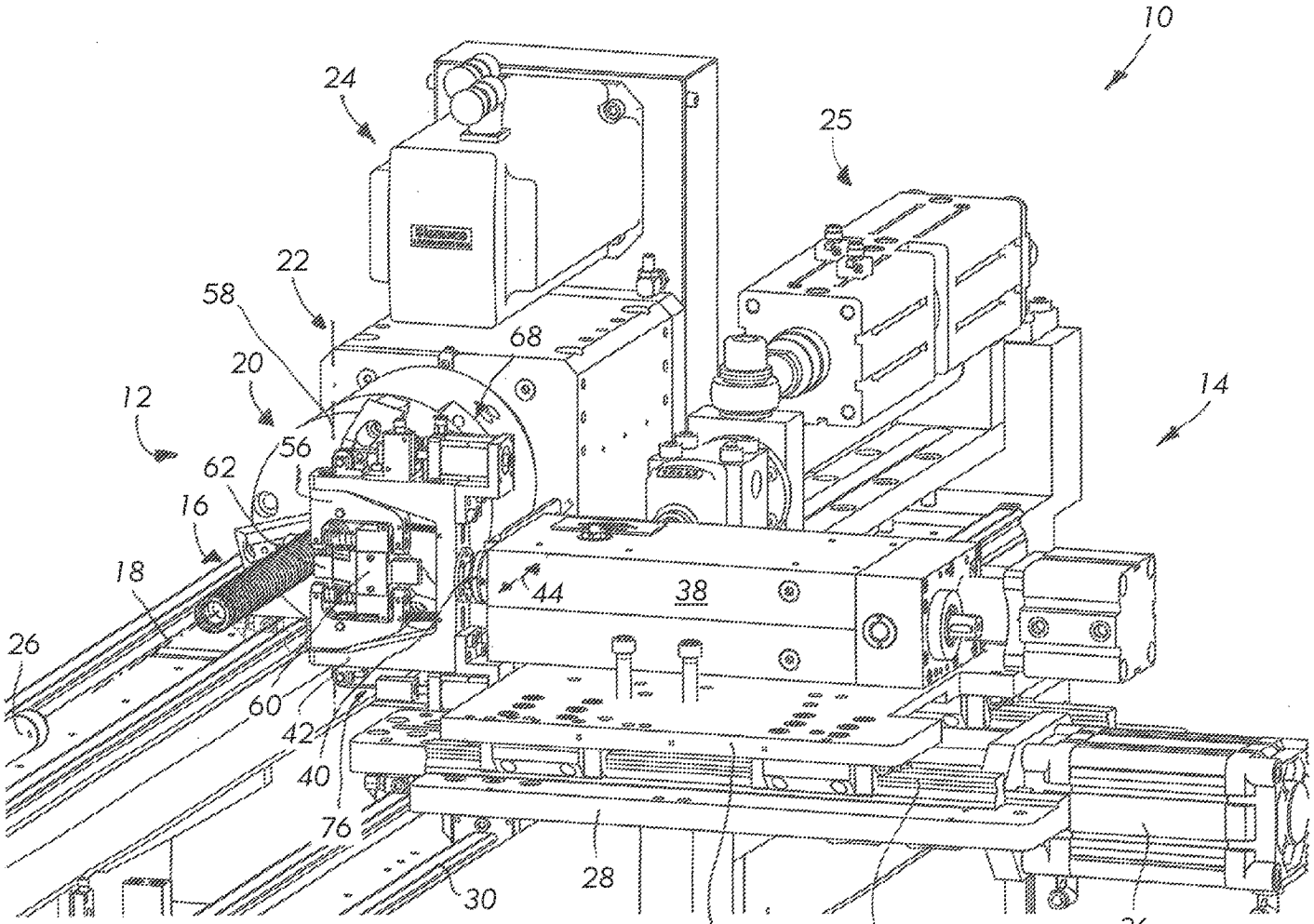
FIG. 1 is a perspective view of a finishing device.
Figure 2:
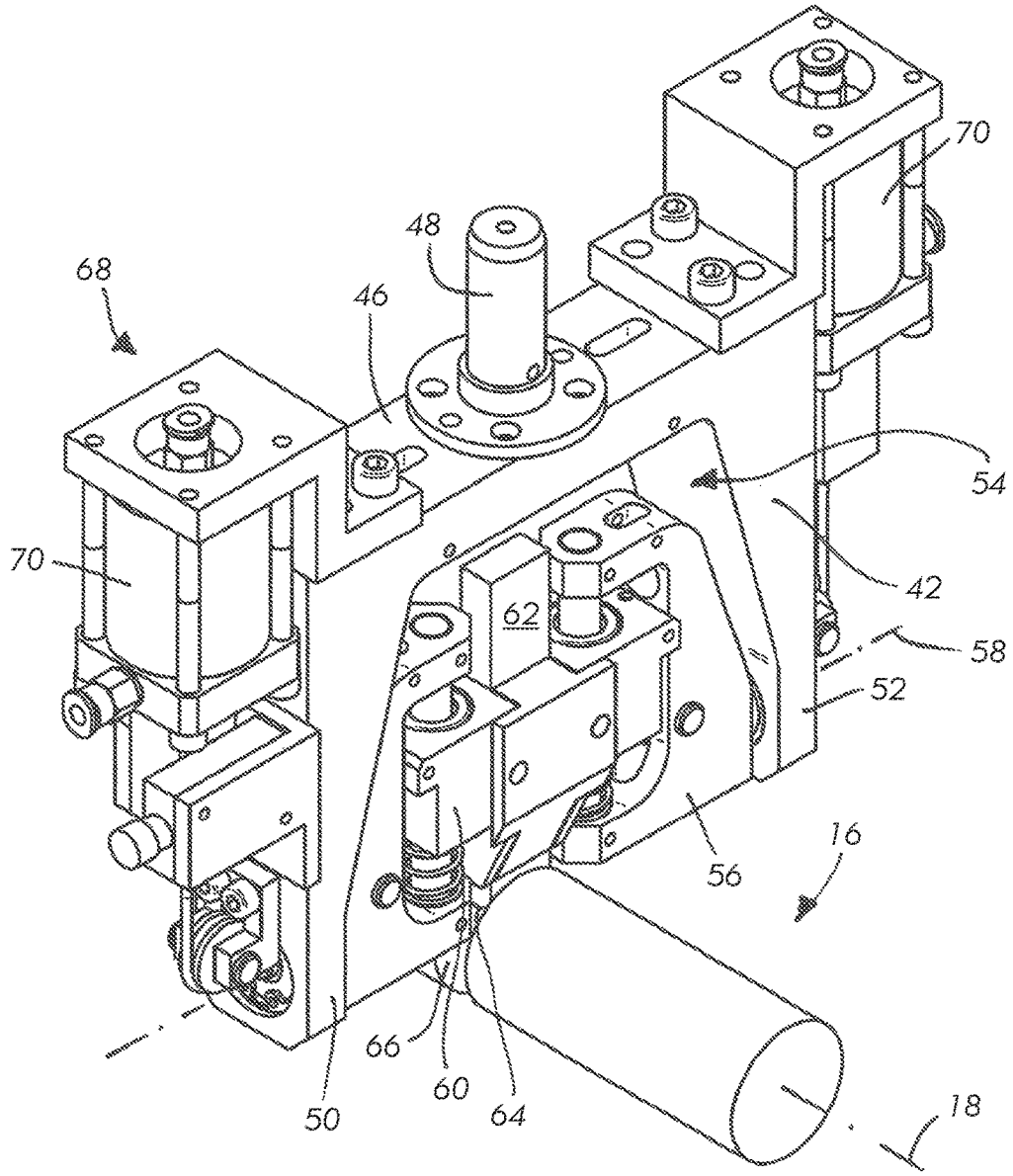
FIG. 2 is a perspective view of an assembly of the finishing device according to FIG. 1, having a finishing stone in a central pivot position.
Figure 3:
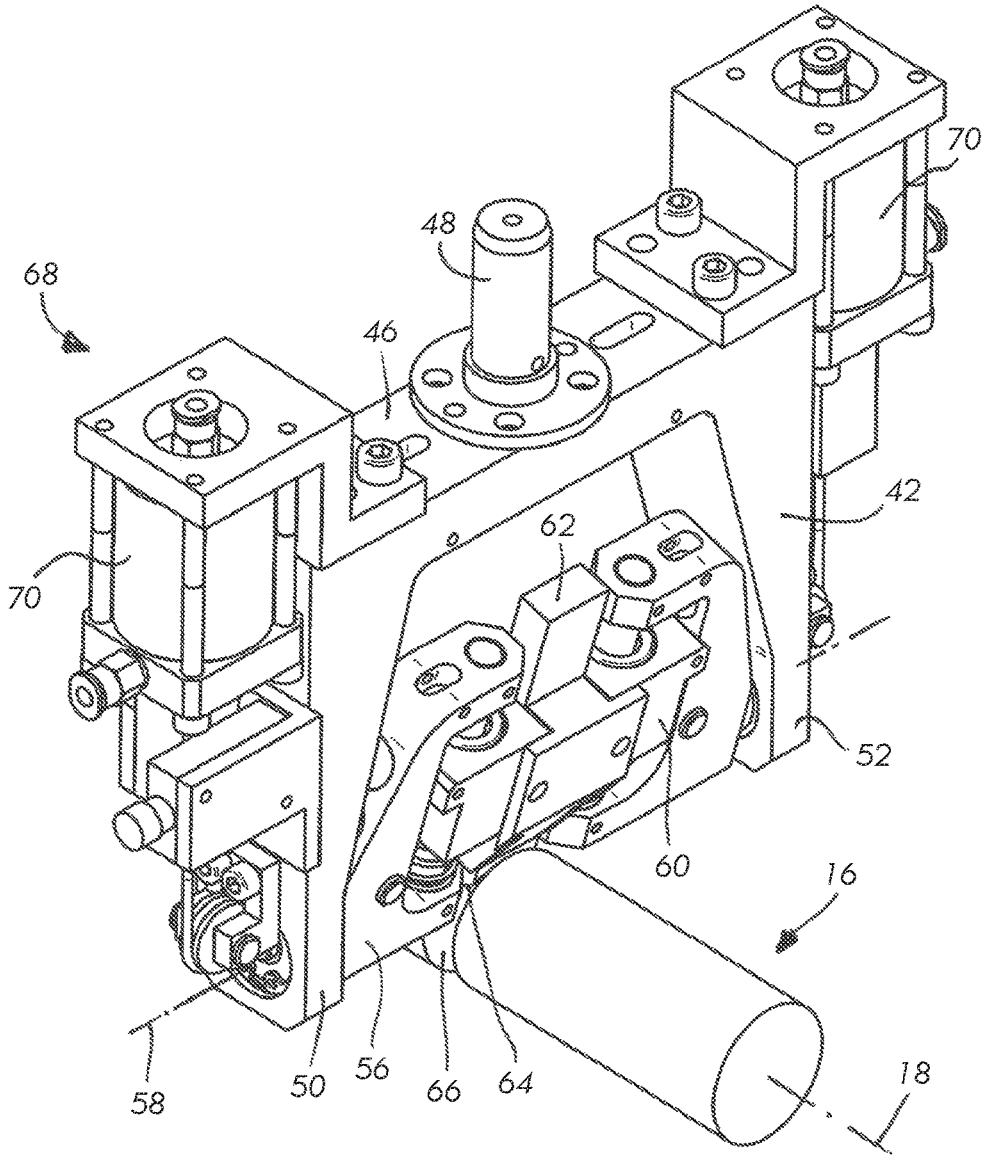
FIG. 3 is a view corresponding to FIG. 2, the finishing stone assuming an end pivot position.

In an embodiment, the present invention provides an additional finishing device which makes possible highly precise finishing machining of a workpiece in machining times that are as short as possible.

According to an embodiment of the invention, the force-generating apparatus is arranged on a mounting apparatus for pivotally mounting the pivot support, and a force-transmitting apparatus is provided for transmitting the pressing force from the force-generating apparatus to the finishing-tool holder.

According to an embodiment of the invention, the force-generating apparatus which is used to generate a force by means of which the finishing tool is pressed against a workpiece to be machined is not arranged on the pivot support, but rather outside the pivot support on a mounting apparatus. This makes it possible to reduce the mass of the pivot support that pivots back and forth. This has the advantage that a pivoting frequency of the pivot support can be increased so that high rates of material removal can be achieved.

Furthermore, reducing the mass of the pivot support has the advantage that the pressing force can reduce counteractive centrifugal forces. The reduction in mass of the pivot support therefore contributes to homogenising the pressing forces.

In order to transmit the force generated by the force-generating apparatus, which is external to the pivot support, to the finishing-tool holder, a force-transmitting apparatus is provided. Compared with the force-generating apparatus, said force-transmitting apparatus can be provided by way of comparatively small and light components, which only slightly increase the mass of the pivot support. Preferably only tensile force is applied to the force-transmitting apparatus, and therefore tensile forces can be transmitted, but not compressive forces.

The finishing tool is in particular a finishing stone; however, it is also conceivable for the finishing tool to be formed by an assembly which comprises a finishing belt and a pressing body, the pressing body being attached to the finishing-tool holder and a pressing surface thereof pressing against a rear face of the finishing belt, which in turn transmits this pressing force through the material of the finishing belt to a grinding face on the front of finishing belt.

It is particularly preferable for the force-transmitting apparatus to comprise at least one cable element, in particular to be designed as a cable element. In such a cable element, metal cables and/or wire cables may be used; however, it is also particularly preferable to use a plastics cable. One cable material that is mechanically particularly robust and at the same time media-resistant is DYNEEMA, a registered trade mark of DSM, the Netherlands.

It is further preferable for a deflecting apparatus (for example, deflecting rollers) to be provided on the pivot support and/or on the mounting apparatus for deflecting portions of the force-transmitting apparatus. In this way, degrees of freedom are produced for arranging the different components of the finishing device, in particular of the pivot support, of the finishing-tool holder, of the mounting apparatus and of the force-generating apparatus.

In a particularly preferred embodiment of the invention, it is provided that at least one portion of the force-transmitting apparatus extends coaxially with the pivot axis of the pivot support. This has the advantage of the force-transmitting apparatus only being subjected to an only slight additional load, namely torsion, in the region of the pivot axis of the pivot support.

In a particularly preferred embodiment of the invention, it is provided that a pivot bearing comprising a bearing bushing is provided for pivotally mounting the pivot support, which bushing comprises a cavity through which at least one portion of the force-transmitting apparatus is guided. In this way, a particularly compact arrangement can be produced in which a cable element of the force-transmitting apparatus is only slightly subjected to an additional torsional load in addition to a tensile load.

It is noted that the force-transmitting apparatus, in particular a cable element, may also be made up of a plurality of portions and that these portions may also be interconnected by means of coupling parts that can turn freely relative to one another in the rotational direction. In this way, even a torsional load as mentioned above on the cable element can be prevented.

Another embodiment of the invention provides that a sensor apparatus is provided for detecting an operating state of the force-transmitting apparatus, and that an operating state of the force-transmitting apparatus that is detected by the sensor apparatus corresponds to a wear state of a finishing tool designed as a finishing stone. For example, it may detect to what extent a cable element has to be pulled up from the perspective of the force-generating apparatus in order to generate a given pressing force. This amount not only depends on the pressing force, but also on the wear state of the finishing stone.

It is possible, for example, to connect a cable element to a reference surface or to provide said element with visual markers, which surface and/or markers are scanned by a preferably contact-free sensor, for example an inductive sensor.

In the following, preferred embodiments of the mounting apparatus which is used for pivotally mounting the pivot support are discussed.

In a preferred embodiment, the mounting apparatus comprises a base support, on which the pivot support is pivotally mounted.

Furthermore, it is preferable for the mounting apparatus to comprise a stand for arranging the base support.

The force-generating apparatus may be arranged on the base support or on the stand.

However, it is preferable for the force-generating apparatus to be arranged on the base support, in particular if the base support is movably mounted on the stand, that is to say is movable relative to the stand.

It is particularly preferable for an oscillation apparatus to be provided to generate a linear oscillating movement of the base support relative to the stand. In this way, the base support can be set into a linear oscillating movement which is converted into a pivoting movement by means of the pivot support and the contact of the grinding face of the finishing tool with the workpiece surface to be machined. Here, it is preferable for a distance of the pivot axis of the pivot mount, which distance is measured in the radial direction relative to the workpiece to be machined, from the workpiece axis to remain constant. In this way, the contact geometry of the grinding face of the finishing tool does not change, irrespective of a wear state.

An embodiment of a finishing device is denoted in its entirety in FIG. 1 by reference numeral 10. The finishing device 10 comprises a workpiece holder 12 and a tool region 14.

The workpiece holder 12 is used to position a workpiece 16 and to drive said workpiece in rotation about a workpiece axis 18. The workpiece 16 is for example in the form of a threaded spindle, is fixed in a jaw chuck 20 of a headstock 22 by a portion which is preferably not provided with a thread and can be driven in the rotational direction by means of a drive motor 24.

It is also possible to clamp a workpiece 16 between two tips of a headstock 25 and a tailstock 26 and to drive said workpiece in the rotational direction by means of the headstock 25.

The tool region 14 comprises a first carriage 28, which can be moved along a guide of a preferably stationary stand 30 in a direction parallel to the workpiece axis 18. For this purpose, a known drive can be used. The first carriage 28 is used for mounting a second carriage 32, which is movable relative to the carriage 28 and perpendicularly to the workpiece axis 18 and is guided along guides 34. A feed drive 36 is provided to drive the second carriage 32 in the direction (feed direction) perpendicular to the workpiece axis 18.

The second carriage 32 receives an oscillating drive 38 that is rigidly connected to the second carriage 32. Such a drive is known per se from the prior art. For example, the rotational movement of a drive motor is converted into an oscillating movement by means of a cam. This oscillating movement is present at an output shaft 40 of the oscillating drive 38, so that a substantially U-shaped base support 42 that is connected to the output shaft 40 is caused to move back and forth (oscillating movement) in a linear manner by means of the oscillating drive 38. This oscillating movement is indicated in FIG. 1 by a double-headed arrow denoted by reference numeral 44. The axis of the oscillating movement 44 of the base support 42 extends in parallel with the workpiece axis 18.

The structure of the base support and of the components connected to the base support 42 is explained in the following with reference to FIGS. 2 to 5.

The base support 42 comprises a base 46, to which a coupling part 48 is attached which cooperates with the output shaft 40 of the oscillating drive 38.

Two arms 50 and 52 project from the base 46 and define an installation space 54 together with the base 46.

The installation space 54 is used to arrange a pivot support 56, which can be pivoted about a pivot axis 58 (see also FIG. 1) relative to the base support 42. The pivot axis 58 extends so as to be offset from and perpendicular to the workpiece axis 18.

The pivot support 56 is used to guide a finishing-tool holder 60, to which a finishing tool in the form of a finishing stone 62 is attached. In the following, the finishing-tool holder 60 is therefore also referred to as a finishing-stone holder 60. The finishing stone 62 has a grinding face 64 that faces the workpiece 16, is in particular curved and cooperates with a workpiece surface 66 of the workpiece 16 that is curved in a manner complementary thereto.

In order to generate a pressing force which presses the grinding face 64 of the finishing stone 62 against the workpiece surface 66 to be machined, a force-generating apparatus 68 is provided. In a preferred embodiment, said apparatus comprises at least one, in particular two, pneumatic or hydraulic cylinders 70.

Figure 4:
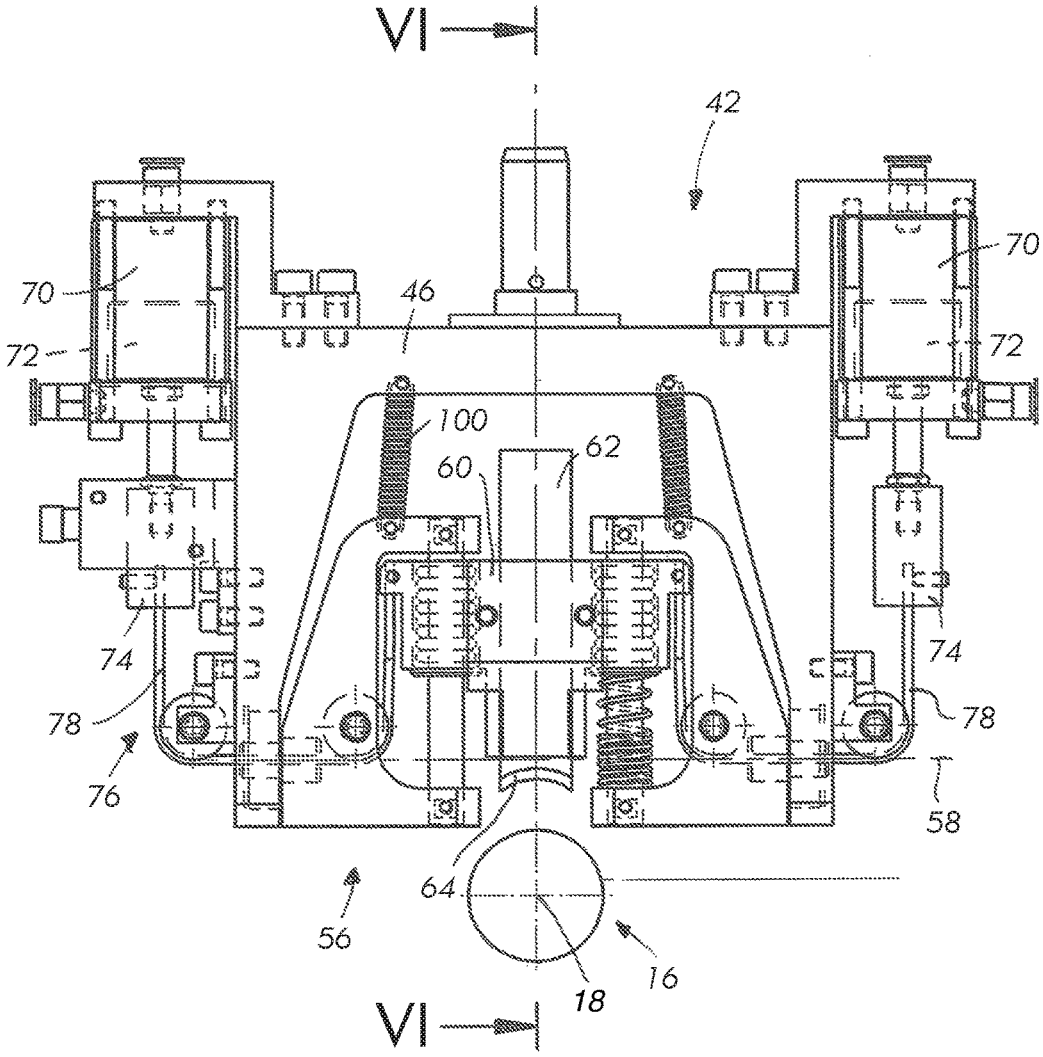
FIG. 4 is a front view of the assembly according to FIG. 2.
Figure 5:
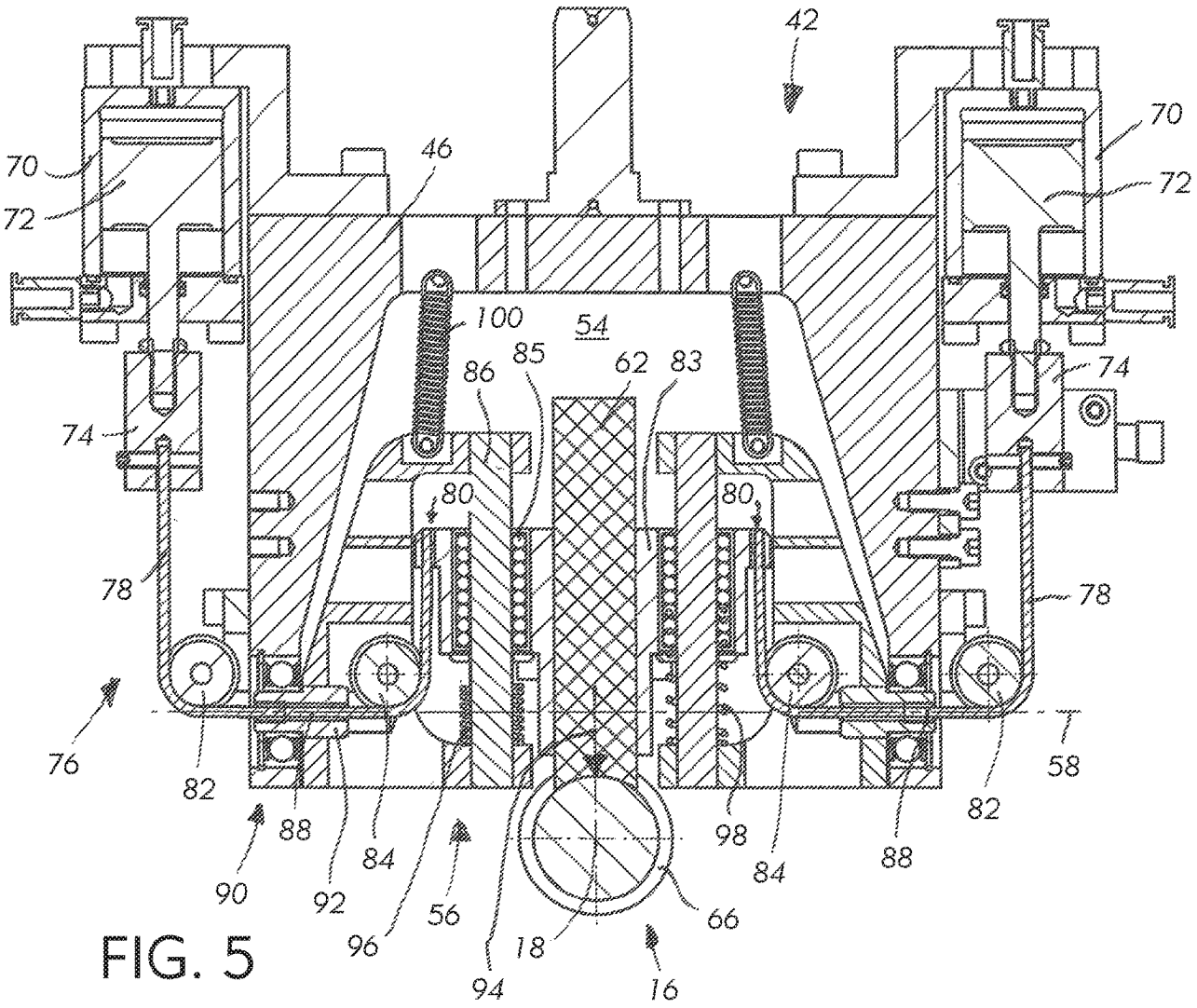
FIG. 5 is a sectional view of the assembly according to FIG. 2.

The cylinders 70 are used to receive and guide pistons 72, which are connected to a force-transmitting apparatus 76 by means of a coupling part 74 (see FIGS. 4 and 5). Said coupling part is in particular at least one cable element 78, which is essentially subjected to tensile force.

The at least one cable element 78 is connected to a cable reel 80 of the finishing-stone holder 60 at the end of said cable element that is remote from the coupling part 74.

Deflecting rollers 82 and 84 are provided to deflect the at least one cable element 78, the deflecting rollers 82 being arranged on the base support 42 and the deflecting rollers 84 being arranged on the pivot support 56.

A portion 88 of the cable element 78 which extends between the deflecting rollers 82 and 84 is arranged coaxially with the pivot axis 58 of the pivot support 56. For this purpose, the pivot bearings 90, by means of which the pivot support 56 is pivotally mounted on the base support 42, comprise a bearing bushing 92, which comprises a cavity through which the portion 88 of the cable element 78 is guided.

Depending on an operating pressure of the cylinders 70, the pistons 72 exert a tensile force on the cable elements 78. This tensile force is transmitted and deflected along the cable elements 78, towards the cable reel 80 of the finishing-stone holder 60.

The cable reels 80 are part of a bearing body 83 that is guided on linear guides 86 of the pivot support 56 by means of linear bearings 85. The bearing body 82 is also used to receive and attach the finishing stone 62.

If the cable elements 78 are subjected to tensile force, the grinding face 64 of the finishing stone 62 is pushed towards the workpiece 16 and acts on the workpiece surface 66 to be machined with a pressing force 94. The pressing force 94 is oriented substantially radially relative to or so as to be inclined relative to the workpiece axis 18.

It is possible, but not necessary, for a starting position of the finishing-stone holder 60 relative to the pivot support 56 to be specified, in particular a starting position in which the finishing-stone holder 60 is arranged so as to be remote from the workpiece 16. For this purpose, compression springs 96, 98 may be provided which counteract the tensile force of the cable elements 78. When the force-generating apparatus 68 is inactive, the compression springs 96, 98 push the finishing-stone holder 60 away from the workpiece 16 towards the base 46 of the base holder 42.

The springs 96 and 98 are preferably identical in terms of the dimensions and spring forces thereof. The spring 96 is shown in a state in which it is compressed to a maximum and in which the finishing-stone holder 60—in a different manner to FIG. 5—assumes a maximum position, directed towards the workpiece 16, relative to the pivot support 56. The spring 98 is—again in a different manner to FIG. 5, and for reasons of clarity shown as overlapping with the linear guide 84—fully relieved of tension; this state corresponds to the starting position of the finishing-stone holder 60, in which the finishing-stone holder 60 is retracted to a maximum into the installation space 54 in the base support 42.

Instead of the compression springs 96, 98, or in addition thereto, tensile elements (springs, cables, etc.) that act in the direction of the base 46 of the base holder 42 may be used in order to bring the finishing-stone holder 60 into a starting position that is remote from the workpiece 16, as required.

Figure 6:
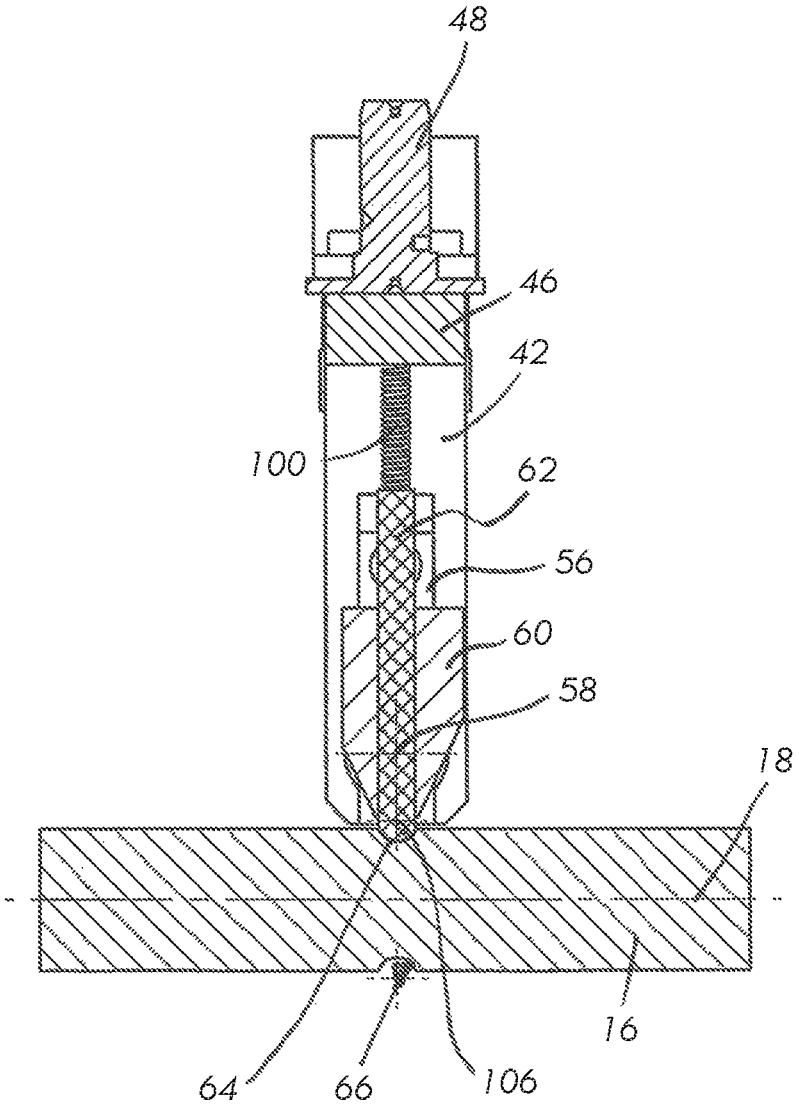
FIG. 6 is a sectional view of the assembly according to FIG. 2 in a sectional plane which is denoted in FIG. 4 by VI-VI and extends perpendicularly to the sectional plane according to FIG. 5, the finishing stone assuming the central pivot position thereof.
Figure 7:
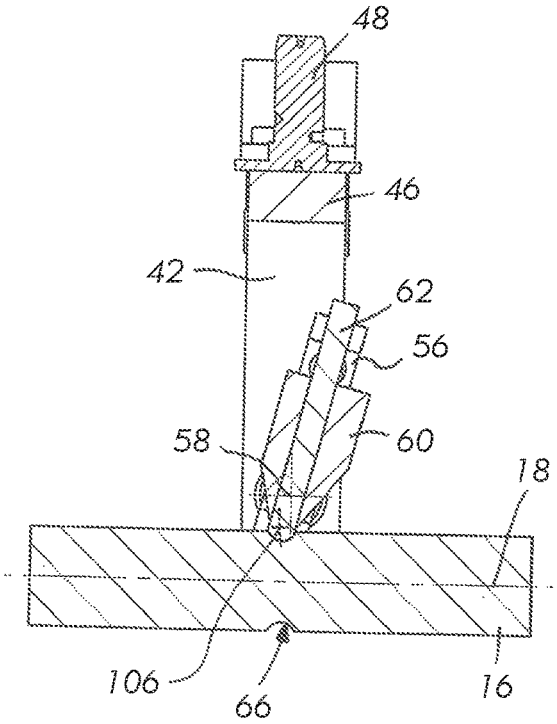
FIG. 7 is a view corresponding to FIG. 6, the finishing stone assuming a first end pivot position.
Figure 8:
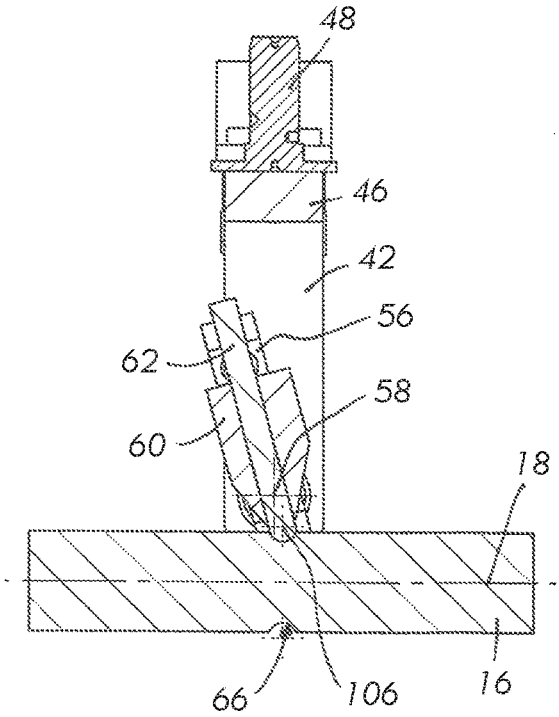
FIG. 8 is a view corresponding to FIG. 6, the finishing stone assuming a second end pivot position.

A central pivot position of the finishing-stone holder 60 and of the finishing stone 62 shown in FIG. 4 to 6 can be specified in that the pivot support 56 cooperates with the base 46 of the base support 42 by means of tension springs 100. Starting from the central pivot position shown in FIG. 6, the tension springs 100 are elongated when the pivot support 56 deflects into a first pivot position (see FIG. 7) or into a second pivot position (see FIG. 8) that is opposite said first position, so that the pivot support 56 attempts to return to the central pivot position from the end pivot positions. The energy of the tension springs 100 stored in the end positions promotes an accelerated movement of the pivot support 56 back into the central pivot position.

Figure 9:
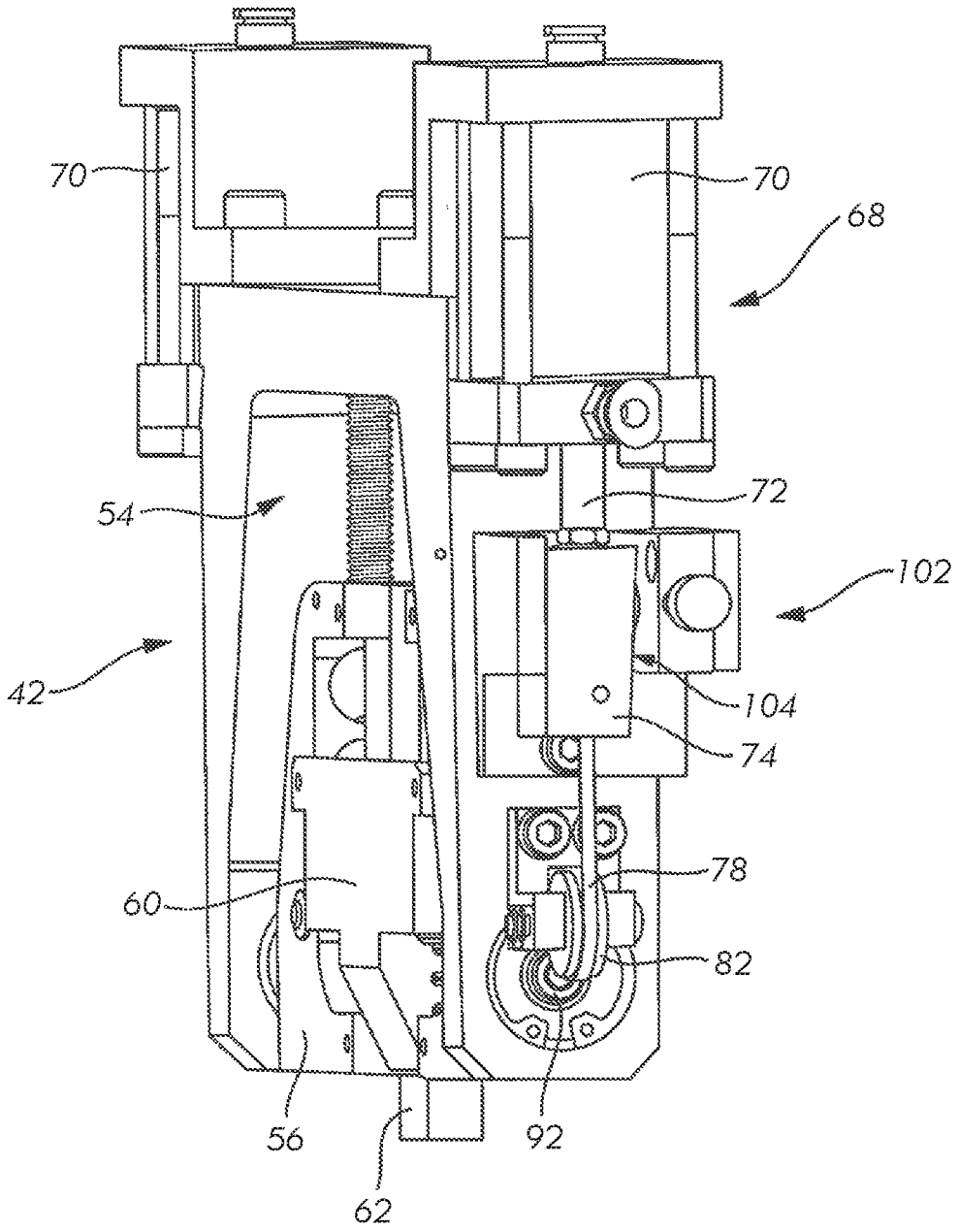
FIG. 9 is a perspective view of the assembly according to FIG. 2.

It is possible to detect a wear state of the finishing stone 62 by monitoring an operating state of the force-transmitting apparatus 76. This is described in the following with reference to FIG. 9.

Wear of the finishing stone 62 is accompanied by the cable elements 78 of the force-transmitting apparatus 76 having to be pulled in further towards the cylinders 70 of the force-generating apparatus 68. This change in the position of the cable elements 78 can be detected by a sensor apparatus 102.

The sensor apparatus 102 is preferably arranged on the outside of the installation space 54 of the base support 42 and comprises a sensor for detecting the position of a portion of the at least one cable element 78.

Preferably, a reference surface 104 is provided which is inclined relative to a sensor of the sensor apparatus 102 that preferably operates in a contact-free manner, so that a change in the position of a cable portion is accompanied by the change in a distance between a portion of the reference surface 104 and the sensor. It is particularly preferable for the reference surface 104 to be an integral component of a coupling part 74 that is used for connecting the piston 72 of the cylinder 70 and an end of the at least one cable element 78.

The finishing machining of a workpiece 16 is described in the following with reference to a workpiece 16 in the form of a threaded spindle.

Starting from a position of the finishing stone 62 in which the grinding face 64 is spaced apart from the workpiece surface 66 to be machined, the feed drive 36 is used to move the second carriage 32, the oscillating drive 38 and the base support 42 together with the pivot support 56, the finishing-stone holder 60 and the finishing stone 62 in the radial direction towards the workpiece axis 18 on the workpiece 16.

The finishing stone 62 is in position when the grinding face 64 of the finishing stone 62 is in contact with the workpiece surface 66 or is at a slight distance therefrom. Starting therefrom, final feed travel of the grinding face 64 that may still exist may be bridged by the force-transmitting apparatus 68 by the pistons 72 being retracted into the cylinders 70 and the cable elements 78 being subjected to tension. This causes the finishing-stone holder 60 together with the finishing stone 62 to move towards the workpiece axis 18 of the workpiece 16. When the grinding face 64 is placed against the workpiece surface 66, a pressing force generated by the force-transmitting apparatus 68 is transmitted to the finishing-stone holder 60, and from there to the finishing stone 62, by means of the tensioned cable elements 78, so that the grinding face 64 of said stone exerts a pressing force 94 of the workpiece surface 66.

In order to machine the circumferential thread of the workpiece 16, the workpiece 16 is driven about the workpiece axis 18 in the rotational direction. Depending on the thread pitch, the first carriage 28 is driven in a direction parallel to the workpiece axis 18 at the same time. As a result, a first, linear and uniform displacement movement of the finishing stone 62 in a direction parallel to the workpiece axis 18 is produced. This linear movement is overlaid with a pivoting movement. This pivoting movement is produced by the linear oscillating movement 44 of the oscillating drive 38 that is transmitted to the base support 42 being converted into a pivoting movement of the pivot support 56, by the curved grinding face 64 of the finishing stone 62 being engaged with the curved workpiece surface 66 of the workpiece 16 (see FIGS. 6 to 8). As a result, the grinding face 64 of the finishing stone 62 rolls on the workpiece surface 66 about a central point 106. The central point 106 corresponds to the central point of a sphere, which is provided to roll on the workpiece surface 66 in order to form a spindle drive together with the threaded spindle, for example for use in a motor vehicle steering gear.

Depending on the pivot position of the pivot support 56, the distance between the pivot axis 58 of the pivot support 56 and the central point 106 of the finishing stone 62 changes. This change in distance is compensated by the finishing-stone holder 60 always being held "under tension" by means of the cable elements 78. The cable elements 78 are therefore prevented from being brought into a state without force or tension. For this purpose, it is preferable for the pistons 72 to be guided within the cylinder 70 in a loose fit and preferably without sealing. It is particularly preferable for the pistons 72 to slide within the pneumatic cylinders 70 in an air-cushioned manner.

The force-generating apparatus 68 is preferably attached to the base support 42; however, it may also be arranged on the second carriage 32, the first carriage 28 or the stand 30. The base support 42, the carriages 32 and 28 and the stand 30 together form a mounting apparatus for mounting the pivot support 56.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A finishing device, comprising:

a finishing tool having a grinding face;

a finishing-tool holder configured to hold the finishing tool;

a pivot support which is pivotable about a pivot axis, the finishing-tool holder being movably guided on the pivot support;

a force-generating apparatus configured to generate a pressing force, by means of which the grinding face of the finishing tool is pressed against a workpiece to be machined;

a mounting apparatus for pivotally mounting the pivot support, the force-generating apparatus being arranged on the mounting apparatus; and a force-transmitting apparatus configured to transmit the pressing force from the force-generating apparatus to the finishing-tool holder.

2. The finishing device according to claim 1, wherein the force-transmitting apparatus comprises at least one cable element.

3. The finishing device according to claim 1, further comprising deflecting apparatuses disposed on at least one of the pivot support and the mounting apparatus, the deflecting apparatuses being configured to deflect portions of the force-transmitting apparatus.

4. The finishing device according to claim 1, wherein at least one portion of the force-transmitting apparatus extends coaxially with the pivot axis of the pivot support.

5. The finishing device according to claim 1, further comprising a pivot bearing for pivotally mounting the pivot support, the pivot bearing having a bearing bushing that includes a cavity through which at least one portion of the force-transmitting apparatus is guided.

6. The finishing device according to claim 1, further comprising a sensor apparatus configured to detect an operating state of the force-transmitting apparatus that corresponds to a wear state of the finishing tool designed as a finishing stone.

7. The finishing device according to claim 1, wherein the mounting apparatus comprises a base support on which the pivot support is pivotally mounted.

8. The finishing device according to claim 1, wherein the mounting apparatus comprises a stand for arranging a base support.

9. The finishing device according to claim 8, wherein the base support is movably mounted on the stand.

10. The finishing device according to claim 8, further comprising an oscillation apparatus configured to generate a linear oscillating movement of the base support relative to the stand.

11. The finishing device according to claim 1, wherein the finishing tool is a finishing stone.

* * * * *